US007743787B2

(12) United States Patent
Baugh

(10) Patent No.: US 7,743,787 B2
(45) Date of Patent: Jun. 29, 2010

(54) MUD SAVER VALVE WITH MAGNETIC LATCHING

(75) Inventor: Benton Frederick Baugh, Houston, TX (US)

(73) Assignee: CMV, Corpus Christi, TX (US)

( * ) Notice: Subject to any disclaimer, the term of this patent is extended or adjusted under 35 U.S.C. 154(b) by 360 days.

(21) Appl. No.: 11/825,557

(22) Filed: Jul. 9, 2007

(65) Prior Publication Data

US 2009/0014071 A1 Jan. 15, 2009

(51) Int. Cl.
*F16K 31/12* (2006.01)

(52) U.S. Cl. ..... 137/508; 166/319; 166/321; 166/322; 251/65; 137/493.9

(58) Field of Classification Search ..... 137/493.9, 137/508; 251/65, 64; 166/319, 321, 322, 166/325; 267/140.14
See application file for complete search history.

(56) References Cited

U.S. PATENT DOCUMENTS 2,951,500 A * 9/1960 Hunter ..... 137/493.9
3,270,763 A * 9/1966 Heinz ..... 137/115.18
3,331,385 A 7/1967 Taylor
3,354,898 A * 11/1967 Barnes ..... 137/331
3,368,788 A * 2/1968 Padula ..... 251/65
3,698,411 A 10/1972 Garrett
3,814,376 A * 6/1974 Reinicke ..... 251/65
3,965,980 A 6/1976 Williamson
4,128,108 A * 12/1978 Parker et al. ..... 137/327
4,364,407 A * 12/1982 Hilliard ..... 137/71
4,625,755 A * 12/1986 Reddoch ..... 137/327
4,779,688 A 10/1988 Baugh
4,899,837 A * 2/1990 Baugh ..... 175/218
5,513,395 A * 5/1996 Chlebek et al. ..... 4/329
5,584,465 A * 12/1996 Ochsenreiter ..... 251/65
6,073,904 A * 6/2000 Diller et al. ..... 251/30.03
6,460,620 B1 * 10/2002 LaFleur ..... 166/324

* cited by examiner

*Primary Examiner*—Stephen Hepperle
*Assistant Examiner*—Christopher Pilling

(57) ABSTRACT

A mud saver valve for retaining drilling fluid in the Kelly of a rotary drilling rig for insertion into a Kelly sub with an enlarged opening inside having a valve and hollow piston closing the flow in a first position and having flow through when the hollow piston is moved by flow against a spring to an open position compressing a spring to stack height, the spring being magnetized to provide magnetic latching to assist in holding the hollow piston in the open position at flow rates lower than it would otherwise be held open.

15 Claims, 3 Drawing Sheets

MUD SAVER VALVE WITH MAGNETIC LATCHING

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of invention of this valve pertains to valves and more particularly to a valve assembly of the type known as a Kelly foot valve or a mud saver valve used in the rotary system for drilling oil wells.

Conventional drilling of oil wells uses a drill string or sections of drill pipe to pump drilling mud down to a drilling bit at the bottom of the hole being drilled. The drill string also typically is rotated to provide rotary power to the drilling bit at the bottom of the hole. As the hole is progressively drilled deeper and deeper, sections of drill pipe are added to the drill string to allow continued drilling. These sections are typically 30 feet long. The wells are typically from 1000 to 20,000 feet deep. The drill string is supported in the rotary table of the rig and the upper drive section or Kelly is unscrewed. When it is unscrewed, the mud in the Kelly and the hose connecting the top of the Kelly to the other piping on the rig pours out onto the rig floor.

The pouring of the drilling mud onto the rig floor is expensive because of the cost of the mud and is dangerous to the rig crew as it makes the floor slippery.

Prior art valves have been inserted into the drill string at the foot or lower end of the Kelly with different characteristics and with different degrees of success. One solution has been to place a slim O.D. ball valve in the string which is operated manually by the crew.

Other valves have been added which operate automatically based upon bore pressure or upon throttling of the fluid across the valves. These valves and the valve of the present invention are typically installed in a sub called a Kelly Saver. The term Kelly Saver comes from the fact that the section of square pipe at the top of the drill pipe which is engaged by the rotary table to turn the drill pipe is called the Kelly. Each time 30 feet more the well is drilled, the connection at the bottom of the Kelly is unscrewed and a joint of drill pipe is added to allow further drilling. This causes high wear and reduced life on the relatively expensive Kelly. A short inexpensive section of pipe is normally added to the bottom of the Kelly to take this wear and is typically called a Kelly Saver.

Prior art valves characteristically do not allow the bore thru the valve to be opened for service access down into the string of drill pipe and then put back into service without having to disassemble the mud saver valve from the drill string to put it back together. Some of the alternatives, i.e. U.S. Pat. Nos. 3,698,411 and 3,965,980 require breaking a cap portion at the top of the valve to allow such service. U.S. Pat. No. 4,128,108 discloses a mud saver valve which requires that a pin be sheared to allow such service. U.S. Pat. No. 3,331,385 discloses a valve in which an extra part is added with special running tools to allow opening and then plugging the bore. This provides the limitations of making the hole available for servicing smaller, adding extra parts, and not allowing the critical wear surfaces to be retrieved easily for inspection and/or replacement.

A second problem associated with prior art valves is that of allowing any pressure build-up below the mud saver valve to be sensed by pressure gages above the mud saver valve. This might occur when the mud is not being pumped. If unstable well conditions exist in which a blowout threatens, watching the pressure in the drill pipe above this valve is critical in the process of knowing how to control the well. Typical prior art valves such as those listed above included added components to act as check valves to allow flow in the direction going up the well.

Prior art valve U.S. Pat. No. 4,899,837 provides a similar construction the present invention, however, when flow is reduced, it will prematurely start to close adding throttling wear to the internal components.

SUMMARY OF THE INVENTION

The object of the present invention is to provide a mud valve assembly including a valve means which seals against a piston and prevents flow out of the Kelly portion of the drill pipe string above the rotary table or working level on a rotary drilling oil rig under the low head pressures associated with unscrewing the drill pipe at the rotary table or working lever, will cause the piston to move down and allow free flow under the higher pressures and flow rates which normally exist under drilling conditions, and will provide a magnetic latching of the valve in the open position to reduce the flow rate at which the valve tends to close.

DESCRIPTION OF THE PREFERRED EMBODIMENT

Figure 1:
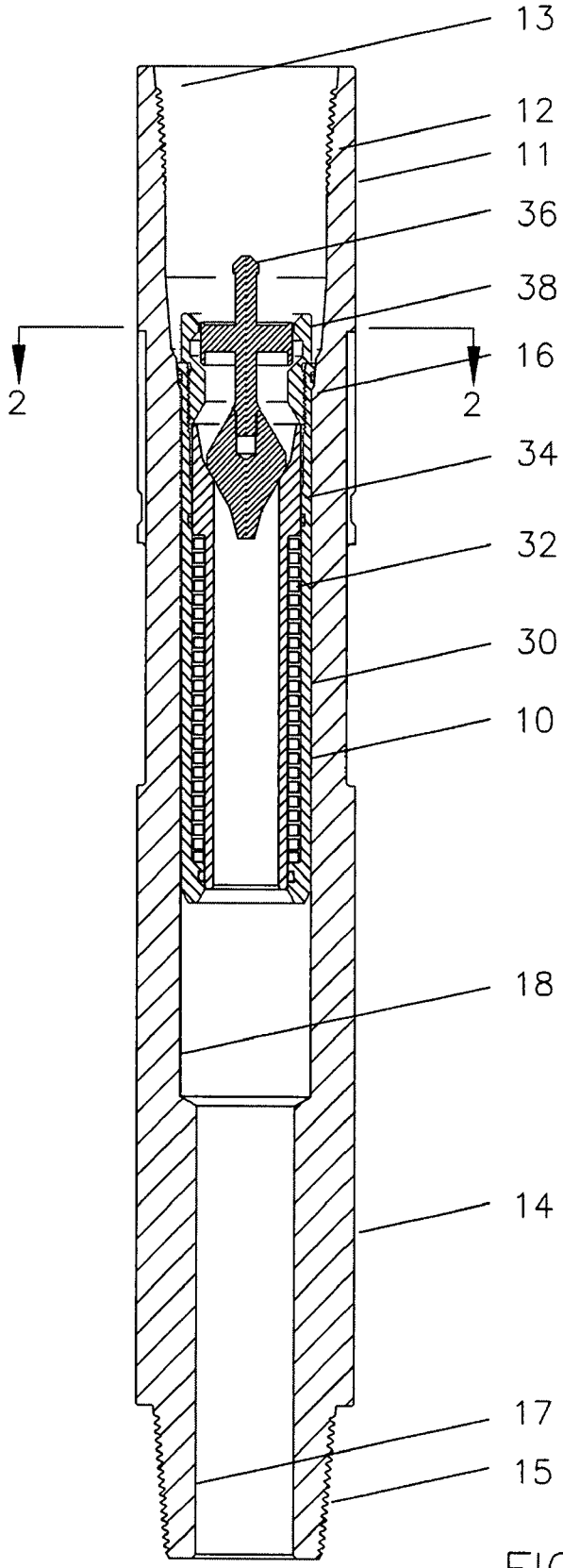
FIG. 1 is a half section of the mud valve assembly of this invention in the first position which is closed and not allowing flow thru the valve.

Referring now to FIG. 1, the mud valve assembly 10, is contained within a section of drill pipe 11 which is normally called a Kelly Saver. The upper end of the Kelly Saver 12 has a female drill pipe thread 13 for connection to the Kelly and the lower end 14 has a male drill pipe thread 15 for connection to the top of the string of drill pipe extending down into the well being drilled.

A tapered shoulder 16 is in the upper end of the Kelly Saver 11 for supporting the mud saver valve 10. The bore 17 of the Kelly Saver 11 is the normal thru bore which would exist in a sub of this type, and the bore 18 is an enlarged bore in the Kelly Saver machined out to accommodate the mud saver valve assembly 10.

Mud saver valve 10 comprises tubular body 30, spring 32, piston 34, valve 36 and stop body 38.

Figure 2:
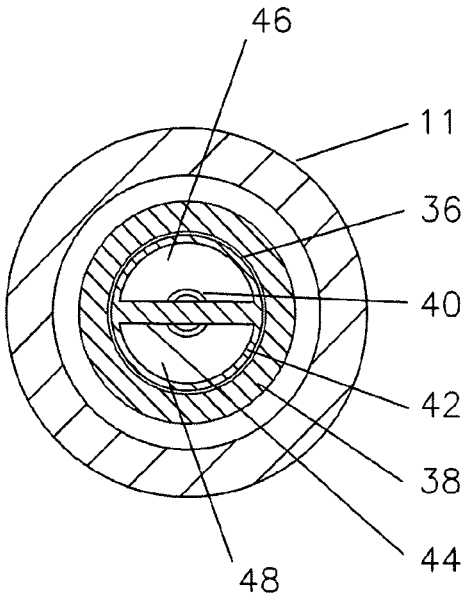
FIG. 2 is a section of the mud valve assembly taken thru the lines 2-2 on FIG. 1.

Referring now to FIG. 2, valve 36 comprises a central member 40, an outer ring 42 and radial arms 44.

Figure 3:
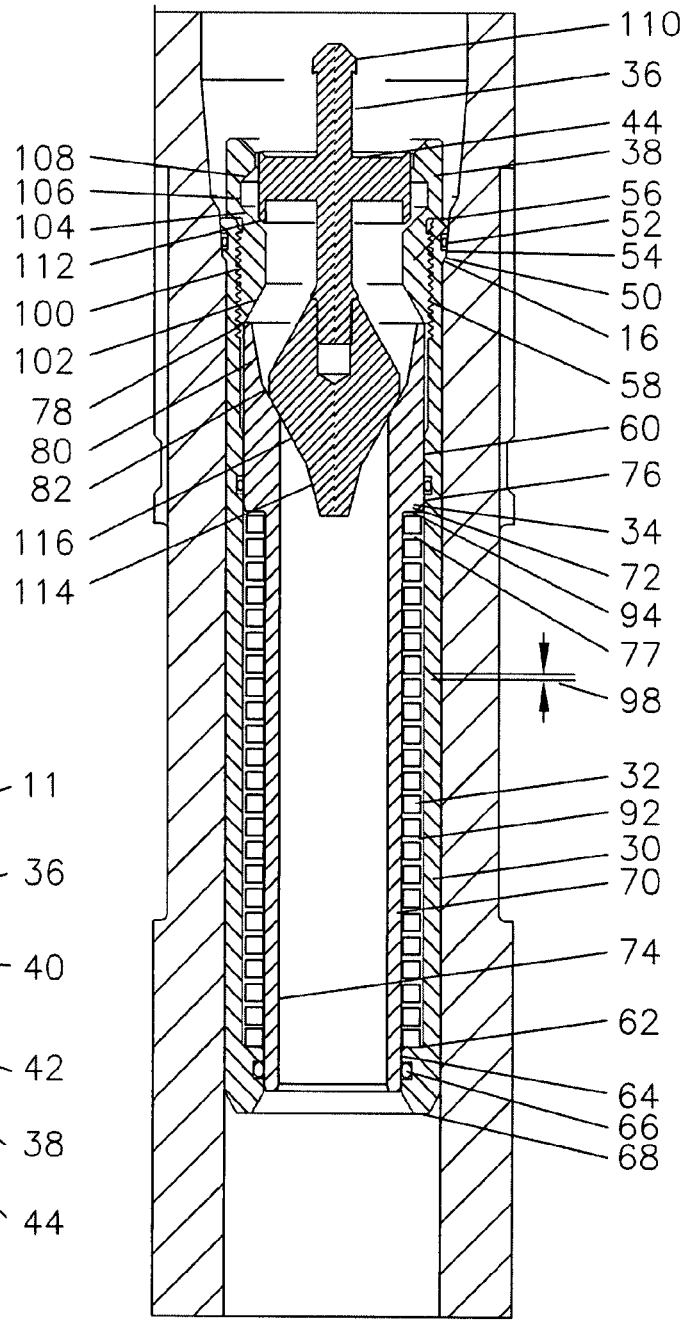
FIG. 3 is a partial half section of the mud valve assembly as shown on FIG. 1.

Referring now to FIG. 3, Tubular body 30 includes an outer tapered shoulder portion 50 which lands on the tapered shoulder 16. Outer tapered shoulder 50 includes a seal groove 52 and a seal ring 54 which seal against the tapered shoulder 16. Tubular body 30 also includes a top shoulder 56, an internal female thread 58, a seal bore 60, an internal shoulder 62, a reduced bore 64, a seal groove 66, and a lower end 68.

Piston 34 includes a long straight portion 70 and an enlarged portion 72. The bore 74 of the piston 34 preferably matches the bore 17 of the Kelly Saver 11. Piston 34 further provides a seal surface 76, an upper shoulder 78, a first tapered surface 80, and a second tapered surface 82 which will also be called the first seal surface 82.

Spring 32 fits into the cavity 92 between the tubular body 30 and the piston 34 and pushes up against shoulder 94 on the piston 34 and reacts against the shoulder 62 on the tubular body 30. The cavity 92 is a sealed cavity with the difference in the areas of the seal bore 60 and the reduced bore 64 acting as a piston area 77 subjected to the pressures within the drill pipe. Under sufficient pressure, this piston area 77 will cause the piston to move against the spring loading and move down until a stop is encountered. In the case of the preferred embodiment, the spring 32 is made of a square wire and stops the movement of the piston 34 when it reaches stack height. In the present closed position, the square wire spring 32 has the individual coils separated by a gap 98 as would be expected in any spring which has not been compressed to stack height.

Stop body 38 provides a male thread 100 to engage the female thread 58 of the tubular body 30, a lower tapered shoulder 102, an upper tapered shoulder 104, and internal profile 106 and an internal shoulder 108. The lowered tapered shoulder 102 is engaged by the upper shoulder 78 (FIG. 3) of the piston 34 to act as the upper stop in the movement of the piston 34. The internal profile 106 with the internal shoulder 108 is intended for removal of the mud saver valve assembly from the Kelly Saver 11.

Valve 36 provides retrieval profile 110, arms 44, outer ring 42, shoulder 112, a first tapered surface 114, and a second tapered surface 116 which will also be referred to as second sealing surface 116. Second seal surface 116 is contacting and sealing against seal surface 82 in the position as shown. In this case sealing refers to preventing of substantial flow and is not intended to require "drop tight" sealing. It is relevant to notice that when the connection 15 (FIG. 1) is unscrewed, all of the fluids inside the bottom of the valve are going to spill out. It is the additional gallons above the valve 36 in the Kelly which this valve is intended to keep from spilling on the rig floor.

As pressure is increased from the top, the combination of the valve 36 and the piston 36 will move down until the gap between the shoulders 104 and 112 is closed. At that time the valve 36 is prevented from moving down further. Additional pressure will cause the piston 34 to move down against the spring force and therefore cause a separation in the seal surfaces 82 and 116. As the combination of pressure and flow increase, the piston 34 will be moved fully down to its lower position and the valve will be fully open.

Figure 4:
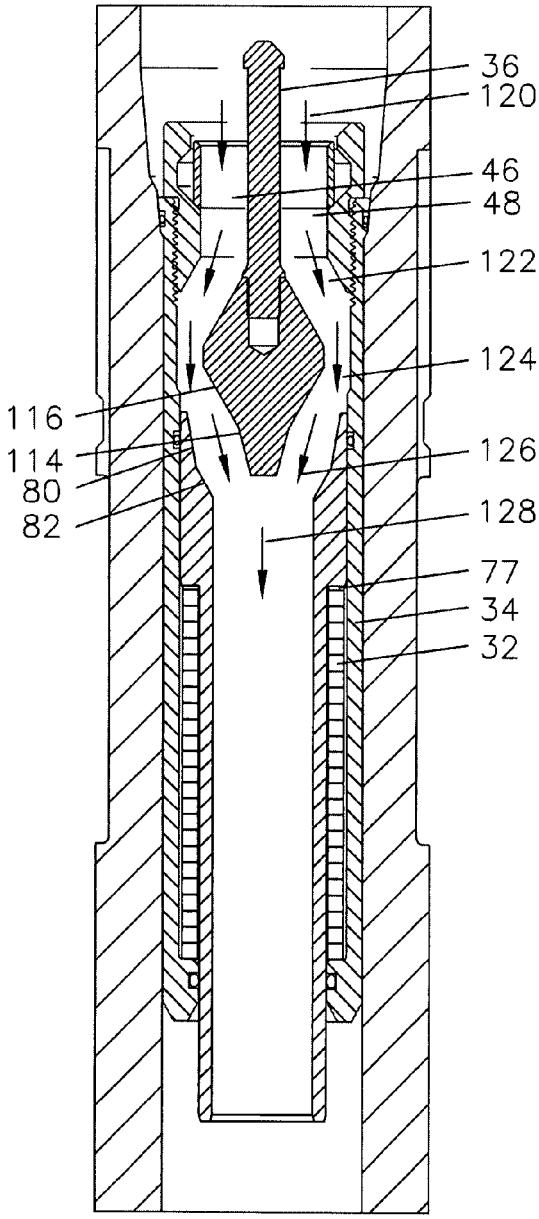
FIG. 4 is a partial half section of the mud valve assembly showing flow in the normal direction from above the valve to below the valve.

Referring now to FIG. 4, arrows 120 thru 128 indicate the flow path thru the assembly when under flowing conditions. The piston 34 has moved fully down and the spring 32 is at its stack height.

Arrow 120 is shown going thru the flow areas 46 and 48 between the arms 44 (FIG. 2) of the valve 36. The tapers 114 and 116 and the tapers 80 and 82 are shown to be instrumental in providing a relatively smooth flow path thru the valve to minimize turbulence and thereby promote longer service life without erosion.

The force of the flow plus the pressure against the piston area at the top of the piston 34 keep the piston in the fully opened position. When these forces diminish below a minimum level, the piston will return to the position as shown in the FIGS. 1 and 3. The ability of the flow and pressure to keep the piston 34 in the lower position are directly proportionate to the values of the forces. It is desirable to have a force which will latch the piston 34 in the fully open position and fully release to allow quick closure of the piston 34 against the valve 36. This can be done by magnetizing the square wire spring 32. Magnetism works generally according to the square of the distance of the parts which are magnetized, so when the parts are very close a high attraction will exist. With small amounts of separation, the force will be reduced substantially, giving the snapping action you observe when you bring magnets close to one another. By magnetizing the spring (whether square wire or round wire), the mud saver valve assembly will stay open for lower flow rate and pressure combinations, and when it starts to close, it will close quicker.

Figure 5:
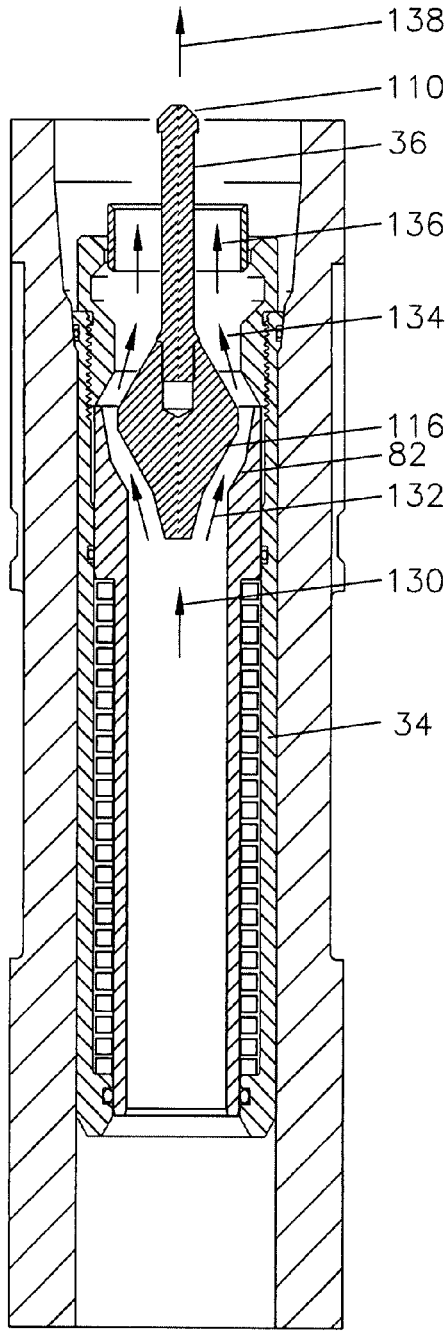
FIG. 5 is a partial half section of the mud valve assembly showing flow in the reverse direction from below the valve to above the valve.

Referring now to FIG. 5, flow of fluids is shown to be coming up from the drill string into the Kelly by arrows 130 to 138. This flow has lifted the valve 36 up so that the second sealing surface 116 has been separated from the first sealing surface 82 and caused a gap between.

The valve 36 will stay in this slightly elevated position as long as flow exists from the drill string. This is essential so that the drilling personnel on the rig floor can monitor the pressures within the well when the pumps are not pumping as in normal drilling.

In like manner the valve 36 can be simply retrieved from the bore by tools readily available on the drilling rigs which will engage the retrieval profile 110.

The foregoing disclosure and description of this invention are illustrative and explanatory thereof, and various changes in the size, shape, and materials, as well as the details of the illustrated construction may be made without departing from the spirit of the invention.

I claim:

1. A mud saver valve for retaining drilling fluid in the kelly of a rotary drilling rig, comprising:

a kelly sub defining an open-ended elongated body having threaded ends for forming a connection between the Kelly and a drill pipe string;

an enlarged bore formed in said elongated body;

a tubular body received within said enlarged bore of said elongated body;

a hollow piston axially disposed within said tubular body, said piston being axially movable relative to said tubular body and defining a fluid passage there through;

a valve removably mounted within said tubular body, said valve cooperating with said piston to normally close the fluid passage through said piston, wherein said hollow piston is movable between a first closed and second open position;

a stop member removably connected to said tubular body, said stop member including a first internal circumferential tapered shoulder for limiting downward movement of said valve; and a magnetized spring for urging said hollow piston into engagement with said valve, said magnetized spring being responsive to flow in a first direction through said mud saver valve to move said hollow piston from a first closed position to a second open position compressing said magnetized spring to the stack height position of said magnetized spring, said magnetized spring being sufficiently magnetized to cause said magnetized spring to urge said magnetized spring to remain in said stack height position when said flow is reduced and thereby to tend to resist said mud saver valve from moving from said second open position to said first closed position.

2. The apparatus of claim 1 wherein said magnetized spring is manufactured from a square wire.

3. The apparatus of claim 1 wherein said magnetized spring is manufactured from a round wire.

4. The apparatus of claim 1 wherein said magnetized spring is manufactured from a rectangular wire.

5. The apparatus of claim 1 wherein said valve means includes a retrieval profile for engagement by a retrieval tool for removal of said valve means from said tubular body.

6. A mud saver valve for retaining drilling fluid in the Kelly of a rotary drilling rig, comprising:

a Kelly sub defining an open-ended elongated body having threaded ends for forming a connection between the Kelly and a drill pipe string;

an enlarged bore formed in said elongated body;

a tubular body received within said enlarged bore of said elongated body;

a hollow piston axially disposed within said tubular body, said piston being axially movable relative to said tubular body and defining a fluid passage there through;

a valve removably mounted within said tubular body, said valve cooperating with said piston to normally close the fluid passage through said piston, wherein said hollow piston is movable between a first closed and second open position;

a stop member removably connected to said tubular body, said stop member including a first internal circumferential tapered shoulder for limiting downward movement of said valve; and a magnetized spring for urging said hollow piston into engagement with said valve, said magnetized spring being responsive to flow in a first direction through said mud saver valve moving said hollow piston from a first closed position to a second open position compressing said magnetized to the stack height of said magnetized wherein adjacent coils are in contact with one another, said magnetized spring being sufficiently magnetized to cause said magnetized spring to urge said magnetized spring to remain in said stack height position when said flow is reduced and thereby to tend to resist said mud saver valve from moving said second open position to said first closed position.

7. The apparatus of claim 6 wherein said magnetized spring is manufactured from a square wire.

8. The apparatus of claim 6 wherein said magnetized spring is manufactured from a round wire.

9. The apparatus of claim 6 wherein said magnetized spring is manufactured from a rectangular wire.

10. The apparatus of claim 6 wherein said valve means includes a retrieval profile for engagement by a retrieval tool for removal of said valve means from said tubular body.

11. A mud saver valve for retaining drilling fluid in the Kelly of a rotary drilling rig, comprising:

a valve removably mounted within said mud saver valve, a hollow piston being axially movable relative to said mud saver valve from a first closed position engaging said valve and a second open position distal from said valve, a magnetized spring for urging said hollow piston into engagement with said valve, said magnetized spring being responsive to flow in a first direction through said mud saver valve urging said hollow piston from a first closed position to a second open position distal from said valve compressing said magnetized spring to the stack height of said magnetized spring wherein adjacent coils are in contact with one another, and said magnetized spring being sufficiently magnetized to cause said magnetized spring to urge said magnetized spring to remain in said stack height position when said flow is reduced and thereby to tend to resist said mud saver valve from moving said second open position to said first closed position.

12. The apparatus of claim 11 wherein said magnetized spring is manufactured from a square wire.

13. The apparatus of claim 11 wherein said magnetized spring is manufactured from a round wire.

14. The apparatus of claim 11 wherein said magnetized spring is manufactured from a rectangular wire.

15. The apparatus of claim 11 wherein said valve means includes a retrieval profile for engagement by a retrieval tool for removal of said valve means from said tubular body.

* * * * *